US008033585B1

(12) United States Patent
Wilson

(10) Patent No.: US 8,033,585 B1
(45) Date of Patent: Oct. 11, 2011

(54) PAINT CAN HOLDER

(76) Inventor: Robert T. Wilson, Valrico, FL (US)

( * ) Notice: Subject to any disclaimer, the term of this patent is extended or adjusted under 35 U.S.C. 154(b) by 114 days.

(21) Appl. No.: 12/587,396

(22) Filed: Oct. 6, 2009

(51) Int. Cl.
*A45F 5/00* (2006.01)

(52) U.S. Cl. ..... 294/159; 206/143

(58) Field of Classification Search ..... 294/159, 294/160, 162, 163, 154; 206/518, 142, 143, 206/162, 175, 562; 220/23.8; 229/117.14, 229/117.15
See application file for complete search history.

(56) References Cited

U.S. PATENT DOCUMENTS 2,362,331 A * 11/1944 Weber ..... 294/159
2,405,517 A * 8/1946 Plummer ..... 206/162
2,519,149 A * 8/1950 McWethy et al. ..... 294/159
2,759,629 A * 8/1956 Sargent ..... 206/199
3,098,805 A * 7/1963 Ervin, Jr. et al. ..... 205/397
3,891,084 A * 6/1975 Elizondo-Garcia ..... 206/143
4,319,761 A * 3/1982 Wells ..... 220/23.4
5,415,277 A * 5/1995 Berntsen ..... 206/144
5,833,056 A * 11/1998 Goldman ..... 206/199
D446,453 S * 8/2001 Brenner ..... D9/434

* cited by examiner

*Primary Examiner* — Paul T Chin
(74) *Attorney, Agent, or Firm* — Edward P Dutkiewicz

(57) ABSTRACT

A paint can holder comprising a base and an upright member coupled to the base. There are a pair of connecting straps, with each strap being coupled to each of the upright members. There is a handle coupled to the upright member. The handle has a first end and a second end. There is at least one ring. The ring is located around the handle.

4 Claims, 3 Drawing Sheets

FIG 1
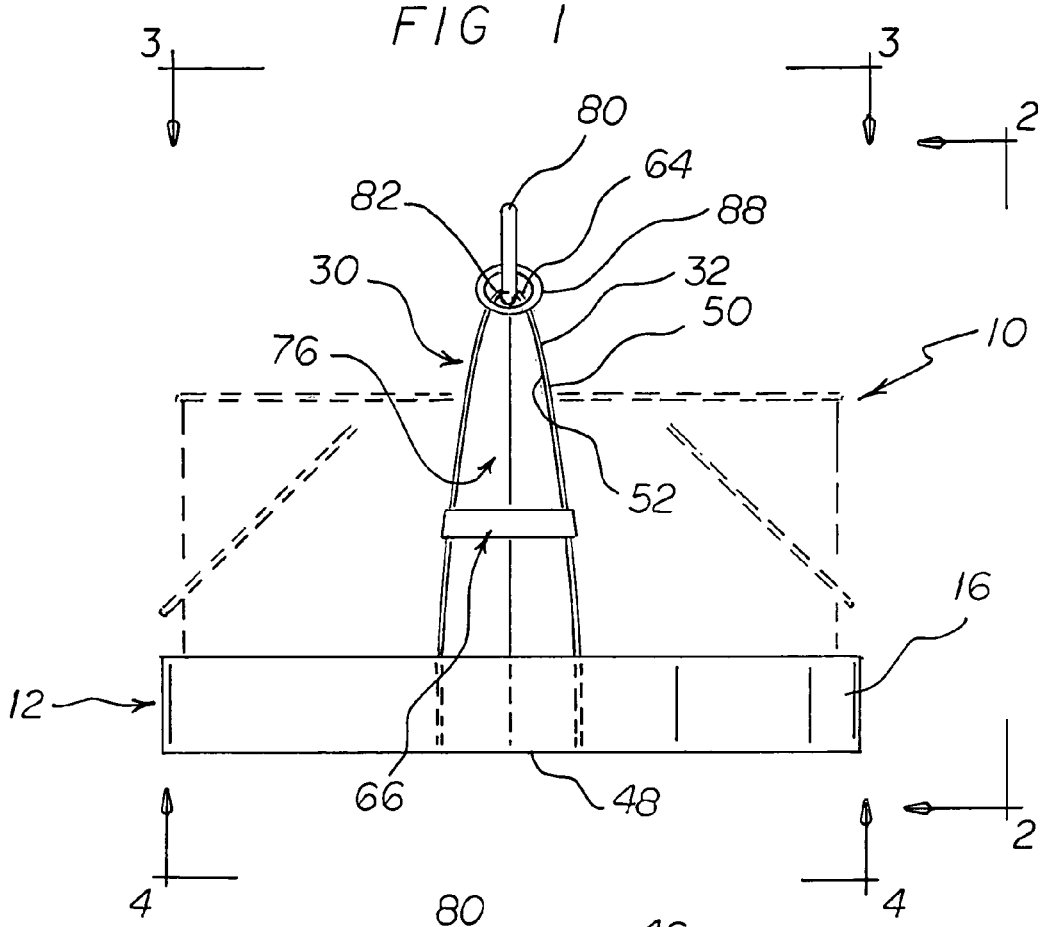
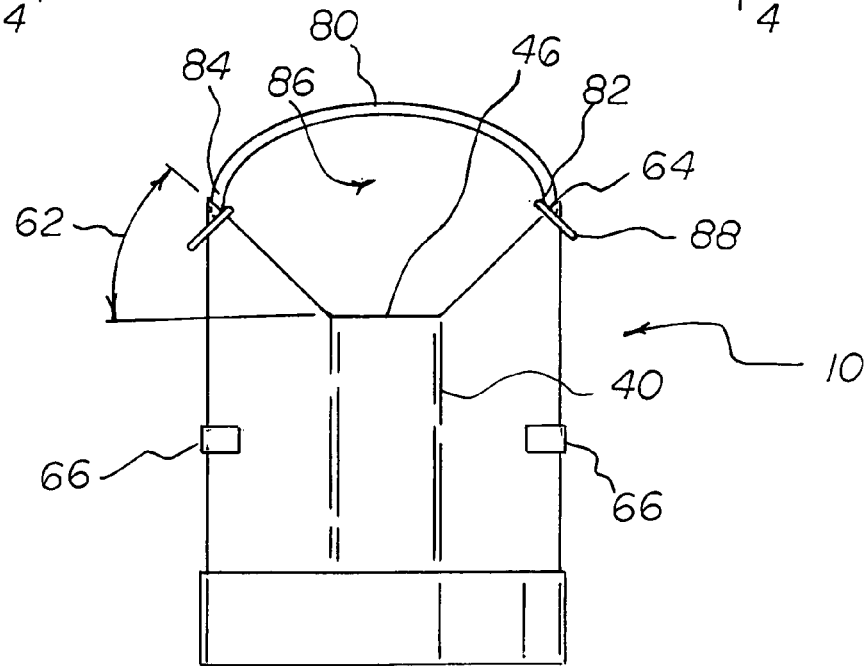
FIG 2

FIG 3
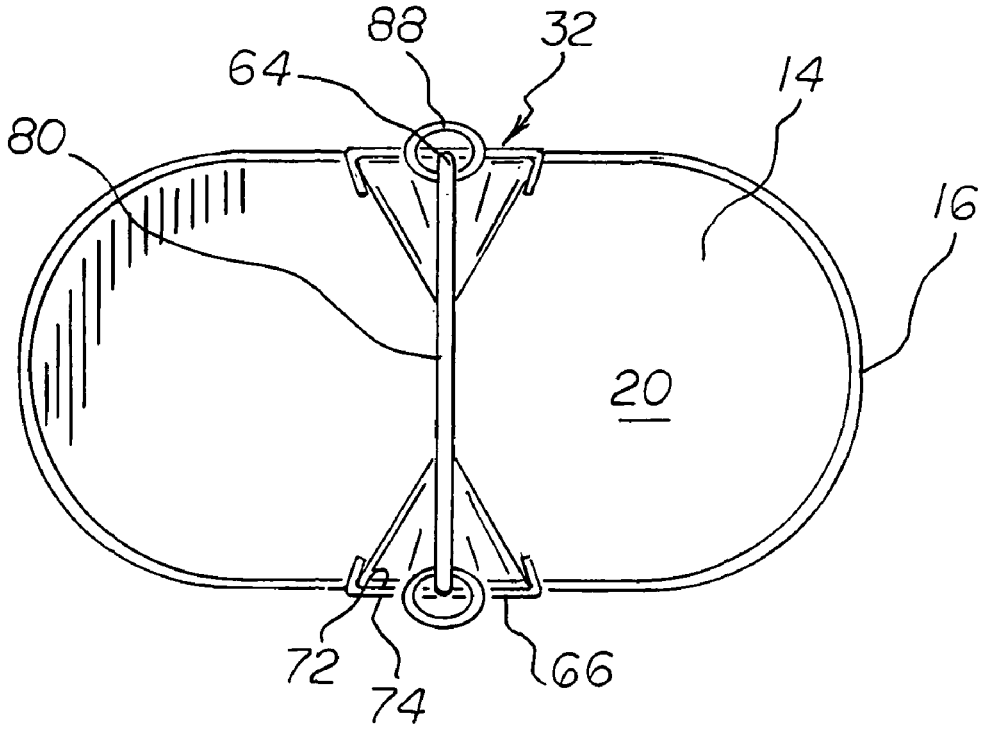
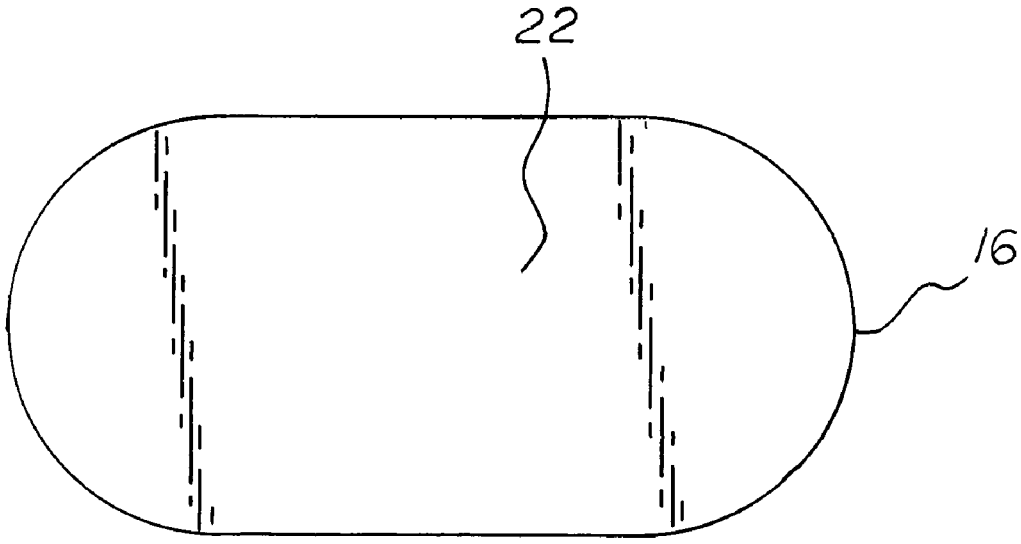
FIG 4

PAINT CAN HOLDER

RULE 1.78(F) (1) DISCLOSURE

The Applicant has not submitted a related pending or patented non-provisional application within two months of the filing date of this present application. The invention is made by a single inventor, so there are no other inventors to be disclosed. This application is not under assignment to any other person or entity at this time.

BACKGROUND OF THE INVENTION

1. Field of the Invention

The present invention relates to a paint can holder and more particularly pertains to a novel way of carrying two paint cans at the same time.

2. Description of the Prior Art

The use of paint can holders is known in the prior art. More specifically, paint can holders previously devised and utilized for the purpose of carrying at least one can of paint are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the prior art does not describe a paint can holder that allows the carrying two paint cans at the same time.

In this respect, the paint can holder according to the present invention substantially departs from the conventional concepts and designs of the prior art, and in doing so provides an apparatus primarily developed for the purpose of a carrying two paint cans at the same time.

Therefore, it can be appreciated that there exists a continuing need for a new and improved paint can holder which can be used for carrying two paint cans at the same time. In this regard, the present invention substantially fulfills this need.

SUMMARY OF THE INVENTION

In view of the foregoing disadvantages inherent in the known types of paint can holders now present in the prior art, the present invention provides an improved paint can holder. As such, the general purpose of the present invention, which will be described subsequently in greater detail, is to provide a new and improved paint can holder which has all the advantages of the prior art and none of the disadvantages.

To attain this, the present invention essentially comprises a paint can holder, comprising several components, in combination.

First provided is a base. The base has a bottom and a side, forming a recess there within. The bottom is generally flat with an upper surface and a lower surface, with a bottom thickness there between. The bottom is fabricated of a rigid material. The base side is generally in a plane perpendicular to the bottom.

There is an upright member. The upright member comprises a pair of generally similar supports, with each support having a central lower portion and a pair of mirror image side portions. The central lower portion of each support has a generally rectilinear configuration with an outer surface, an inner surface, a pair of side edges, an upper edge, and a lower edge.

The lower edge of the central lower portion is oriented generally parallel with the bottom and is coupled to the bottom. The central lower portion of each support has a length and a width.

Each side portion of each support has an outer surface and an inner surface, with a thickness there between. Each side portion of each support has a lower edge, an upper edge, an inner edge and an outer edge. The inner edge is continuous with the side edge of the lower central portion. The inner surface of each of the support side portions has a generally concave configuration. The outer surface of each of the support side portions has a generally convex configuration. The lower edge of each support side portions has a straight configuration so as to be parallel with the bottom upper surface and mate with the bottom upper surface. The upper edge of each support side portion has a straight configuration, with the upper edge being oriented at an angle relative to the lower edge of the side portion. The angle of the upper edge is between about five degrees and eighty five degrees, relative to the lower edge. Each upper edge of each support side portion thereby forms a connection point.

There is provided a pair of connecting straps. Each of the connecting strap has a generally rectilinear configuration. Each connecting strap has a length, with a first end and a second end. Each connecting strap has a width. Each connecting strap has an inner surface and an outer surface, with a thickness there between. Each connecting strap is operatively coupled to the outer edge of the adjacent side portions. The connecting strap and the outer surface of the adjacent side portions thereby define a recess.

There is next provided a handle. The handle has a generally round tubular curved configuration. The handle has a first end and a second end. The first end of the handle is coupled to the connecting point of each of the adjacent support side portions. The second end of the handle is coupled to the connecting point of each of the adjacent support side portions. The handle and the side portions thereby form a passageway for a user's hand.

Lastly, there is at least one ring. The ring is located around the handle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved paint can holder which has all of the advantages of the prior art paint can holders and none of the disadvantages.

It is another object of the present invention to provide a new and improved paint can holder which may be easily and efficiently manufactured and marketed.

It is further object of the present invention to provide a new and improved paint can holder which is of durable and reliable constructions.

An even further object of the present invention is to provide a new and improved paint can holder which is susceptible of a low cost of manufacture with regard to both materials and labor, and which accordingly is then susceptible of low prices of sale to the consuming public, thereby making such paint can holder economically available to the buying public.

Even still another object of the present invention is to provide a Paint can holder for carrying two paint cans at the same time.

Lastly, it is an object of the present invention to provide a new and improved paint can holder comprising a base and an upright member coupled to the base. There are a pair of connecting straps, with each strap being coupled to each of the upright members. There is a handle coupled to the upright member. The handle has a first end and a second end. There is at least one ring. The ring is located around the handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the paint can holder. Paint cans are shown in phantom.

FIG. 2 is a view taken along line 2-2 of FIG. 1.

FIG. 3 is a view taken along line 3-3 of FIG. 1.

FIG. 4 is a view taken along line 4-4 of FIG. 1.

The same reference numerals refer to the same parts throughout the various Figures.

DESCRIPTION OF THE PREFERRED EMBODIMENT

Figure 5:
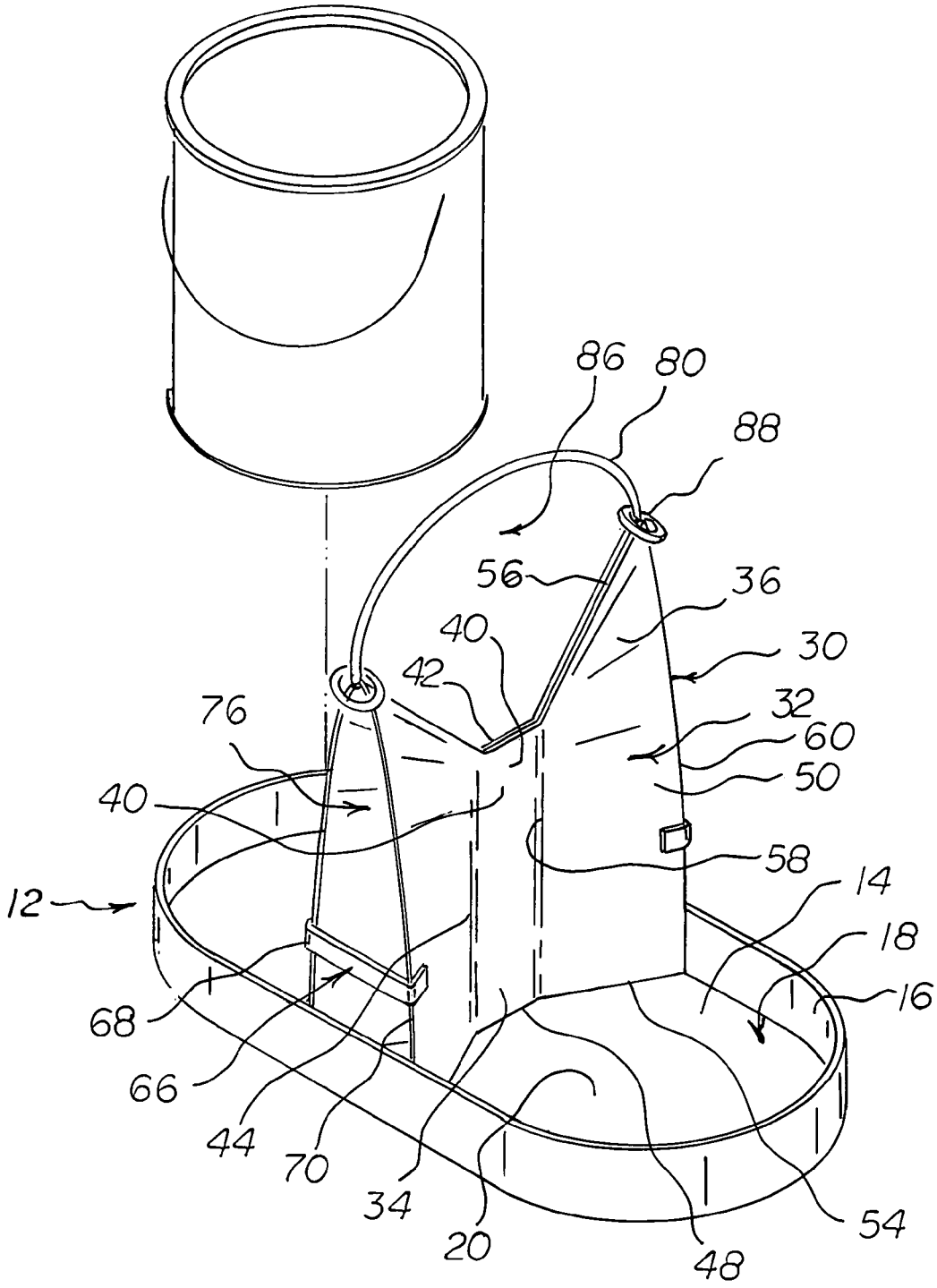
FIG. 5 is a perspective view of the paint can holder, with the location of the paint can being demonstrated by line. Note the recess formed by the side portions and the connecting strap.

With reference now to the drawings, and in particular to FIG. 1 thereof, the preferred embodiment of the new and improved Paint can holder embodying the principles and concepts of the present invention and generally designated by the reference numeral 10 will be described.

The present invention, the Paint can holder 10 is comprised of a plurality of components. Such components in their broadest context include a base, a support, and a handle having an associated ring. Such components are individually configured and correlated with respect to each other so as to attain the desired objective.

A paint can holder 10, comprising several components, in combination.

First provided is a base 12. The base has a bottom 14 and a side 16, forming a recess 18 there within. The bottom is generally flat with an upper surface 20 and a lower surface 22, with a bottom thickness there between. The bottom is fabricated of a rigid material. The base side is generally in a plane perpendicular to the bottom.

There is an upright member 30. The upright member comprises a pair of generally similar supports 32, with each support having a central lower portion 34, and a pair of mirror image side portions 36.

The central lower portion of each support has a generally rectilinear configuration with an outer surface 40, an inner surface 42, a pair of side edges 44, an upper edge 46, and a lower edge 48.

The lower edge of the central lower portion is oriented generally parallel with the bottom and is coupled to the bottom. The central lower portion of each support has a length and a width.

Each side portion of each support has an outer surface 50 and an inner surface 52, with a thickness there between.

Each side portion of each support has a lower edge 54, an upper edge 56, an inner edge 58 and an outer edge 60. The inner edge is continuous with the side edge of the lower central portion.

The inner surface of each of the support side portions has a generally concave configuration. The outer surface of each of the support side portions has a generally convex configuration.

The lower edge of each support side portions has a straight configuration so as to be parallel with the bottom upper surface and mate with the bottom upper surface. The upper edge of each support side portion has a straight configuration, with the upper edge being oriented at an angle 62 relative to the lower edge of the side portion. The angle of the upper edge is between about five degrees and eighty five degrees, relative to the lower edge. Each upper edge of each support side portion thereby forms a connection point 64.

Generally, the upright member supports are configured so as to resemble two spoons in contact with one another at the central portion of the spoon. This configuration of having the side portions curved and angled relative to the lower central portion is herein defined as "spoon-like".

All coupling of the components of the paint can holder, such as the base to the upright member, and upright member to the handle, may be carried out by welding, adhesives, clipping, screwing, bolting riveting and bending.

There is provided a pair of connecting straps 66. Each of the connecting strap has a generally rectilinear configuration. Each connecting strap has a length, with a first end 68 and a second end 70. Each connecting strap has a width. Each connecting strap has an inner surface 72 and an outer surface 74, with a thickness there between. Each connecting strap is operatively coupled to the outer edge of the adjacent side portions. The connecting strap and the outer surface of the adjacent side portions thereby define a recess 76. The recess may be used to carry tubed material, such as caulk.

There is next provided a handle 80. The handle has a generally round tubular curved configuration. The handle has a first end 82 and a second end 84. The first end of the handle is coupled to the connecting point of each of the adjacent support side portions. The second end of the handle is coupled to the connecting point of each of the adjacent support side portions. The handle and the side portions thereby form a passageway 86 for a user's hand.

Lastly, there is at least one ring 88. The ring is located around the handle. A variation of the paint can holder would employ more than one ring, or attachment, such as a clip, loop, snap, tie, and hook. Collectively such attachment devices would be attachment means.

The paint can holder may be clipped to a user's belt, by way of a clip, such as a carabineer clip. The paint can holder may also be attached to a ladder or a scaffold.

The paint can holder allows a user to keep two cans of different colored paint handy for touch up or cover over. The recess allows a tube of caulk to be likewise carried, with two recesses allowing the carrying of two different types or colors of caulk. The holder is fabricated of a light weight material, such as aluminum or plastic. The ring allows a user to also clip the paint can holder to a ladder, or staging.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paint can holder, comprising, in combination:

a base having a bottom and a side forming a recess there within;

an upright member coupled to the base, the upright member comprising a pair of supports with each support having a central lower portion and a pair of mirror image side portions and a central upper portion, each side portion of each support having a outer surface and an inner surface with a thickness there between, each side portion of each support having a lower edge and an upper edge and an inner edge and an outer edge, each upper edge of each support side portion thereby forming a connection point;

a pair of connecting straps each coupled to the upright member, each connecting strap having a generally rectilinear configuration, each connecting strap having a length with a first end and a second end, each connecting strap having a width and an inner surface and an outer surface with a thickness there between;

a handle coupled to the upright member, the handle having a first end and a second end, the handle having a generally round tubular curved configuration; and at least one ring, the ring being located around the handle.

2. The paint can holder as described in claim 1 with the paint can holder further comprising:

the base bottom being generally flat with an upper surface and a lower surface with a bottom thickness there between;

the upright member supports being generally similar wthe central lower portion of each support having a generally rectilinear configuration with an outer surface and an inner surface and a pair of side edges and an upper edge and a lower edge, the inner surface of each of the support side portions having a generally concave configuration, with the outer surface of each of the support side portions having a generally convex configuration, the upper edge of each support side portion having a straight configuration with the upper edge being oriented at an angle relative to the lower edge of the side portion;

each connecting strap being operatively coupled to the outer edge of the adjacent side portions;

the first end of the handle being coupled to the connecting point of each of the adjacent support side portions.

3. The paint can holder as described in claim 2 with the paint can holder further comprising:

the base side being generally in a plane perpendicular to the bottom, the side having an inner surface and an outer surface with a side thickness there between;

the inner edge of each side portion being continuous with the side edge of the lower central portion, the lower edge of the central lower portion being oriented generally parallel with the bottom and is coupled to the bottom;

the angle of the upper edge of each support side portion being between about five degrees and eighty five degrees relative to the lower edge of each support side portion;

the connecting strap and the outer surface of the adjacent side portions thereby defining a recess; and the second end of the handle being coupled to the connecting point of each of the adjacent support side portions.

4. The paint can holder as described in claim 3 with the paint can holder further comprising:

the base bottom being fabricated of a rigid material;

the lower edge of each support side portions having a straight configuration so as to be parallel with the bottom upper surface and mate with the bottom upper surface, the central lower portion of each support having a length and a width; and the handle and the side portions thereby forming a passageway for a user's hand.

* * * * *